United States Patent [19]

Burch et al.

[11] Patent Number: 4,796,355

[45] Date of Patent: Jan. 10, 1989

[54] SNAP ACTION DEVICES AND METHODS AND APPARATUS FOR MAKING SAME

[75] Inventors: Lyndon W. Burch, Boston, Mass.; Hadley K. Burch, Pittsfield, Vt.

[73] Assignee: B/K Patent Development, Inc., Los Angeles, Calif.

[21] Appl. No.: 96,468

[22] Filed: Sep. 15, 1987

[51] Int. Cl.[4] ..... H01H 11/00; H01H 65/00

[52] U.S. Cl. ..... 29/622; 29/756; 29/446; 29/450; 337/379; 228/173.6

[58] Field of Search ..... 29/622, 756, 446, 450, 29/452; 337/343, 365, 379; 200/67 D, 67 DA; 228/103, 173.6

[56] References Cited

U.S. PATENT DOCUMENTS

| | | | |
|---|---|---|---|
| 2,503,008 | 4/1950 | Taylor | 200/138 |
| 2,624,819 | 1/1953 | Spina et al. | 200/138 |
| 2,777,032 | 1/1957 | Burch | 200/113 |
| 3,192,346 | 6/1965 | Slonneger | 200/138 |
| 3,275,773 | 9/1966 | Grover | 200/138 |
| 3,872,417 | 3/1975 | Hufschmid | 337/365 |
| 4,145,587 | 3/1979 | Purssell | 200/67 DA |
| 4,250,367 | 2/1981 | Rossi | 200/67 DA |
| 4,669,182 | 6/1987 | Ferroni et al. | 29/622 |
| 4,727,644 | 3/1986 | Corfield | 29/622 |

*Primary Examiner*—P. W. Echols

*Attorney, Agent, or Firm*—Lahive & Cockfield

[57] ABSTRACT

An inherently mechanically bistable self-supporting blade element for actuating snap-action switches, circuit breakers and devices, and methods and apparatus for producing such elements. The elements are formed from initially flat, unstressed spring material, and comprise two outer legs and a bridging portion integrally connecting them. By progressive coplanar relative displacement of the outer legs the bridging portion is deflected normally to the nominal plane of the element. Detection of this deflection enables attachment together of the outer legs to form a calibrated, inherently bistable blade element.

17 Claims, 4 Drawing Sheets

CUT
CUT
F
12
14
16
18
20
22
24
26
28
30
32
34
36
38
40
42
44
48
50
52
54
56
58
60
62
66
68
69
70
71
72
77
78
80
82

4
4
56
60
68
22
34
26
28
32
38
85
30
36
24
66
98
92
70
58
62
68

82
86
80
78
88
74
84
26
58
62
52
16
18
64
50
76
77
46
90

5
94
96
98
102
16
92
100
5

92
102
106
98
16
100
104

26
22
38
24
98
92
108
98

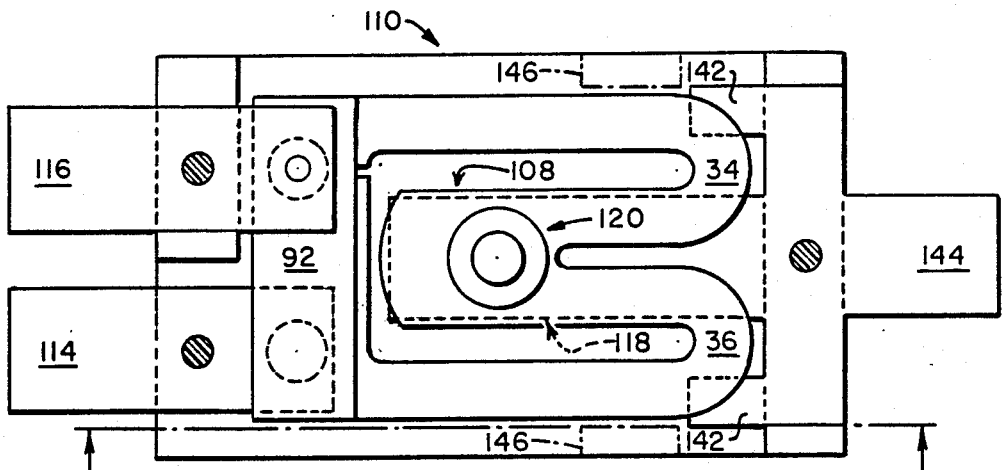
FIG. 8 (TOP COVER REMOVED)
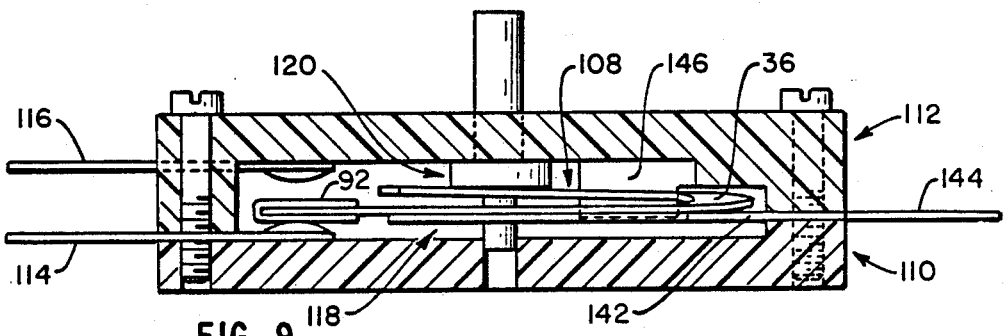
FIG. 9
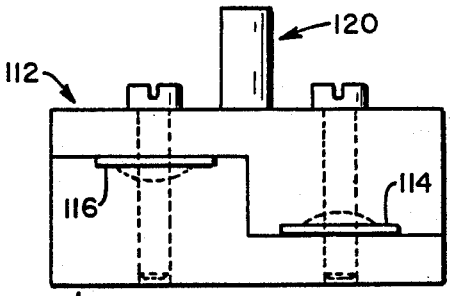
FIG. 10
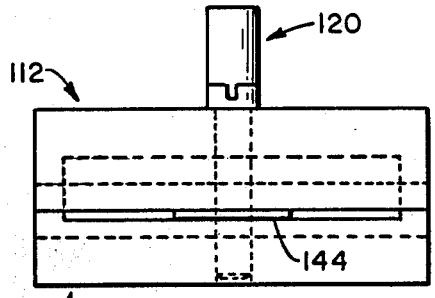
FIG. 11

SNAP ACTION DEVICES AND METHODS AND APPARATUS FOR MAKING SAME

SUMMARY OF THE INVENTION

This invention relates generally to snap-action devices such as switches and circuit breakers. More particularly, it relates to a novel, inherently mechanically bistable blade element that may be assembled or inserted in switches, circuit breakers and other types of devices to enable them to operate by a snap action, and to methods and apparatus for producing such elements cheaply in mass production with accurately calibrated mechanical properties.

In general, any snap action device includes a so-called over-center element that has two positions of mechanical stability. This property is imparted to the element by prestressing it in some manner, the element being confined in a prestressed condition within the assembly. In present practice, snap action devices usually comprise an over-center element that is not inherently prestressed prior to assembly with other elements to form the device. For example, where the over-center element is a blade as described in U.S. Pat. No. 4,424,506 to Lyndon W. Burch, dated Jan. 3, 1984, the blade is prestressed to make it bistable by forcing an edge portion over a pin having a diameter chosen to produce the required stress in the nominal plane of the blade. A necessary condition for producing satisfactory mechanical properties is close control over the dimensions and tolerances of both the blade and the pin, and in use the mechanical properties may change in an undesirable manner as a result of even slight wear at the edge portions of the blade engaging the pin. The last-mentioned example typifies the problems that are encountered when the bistable element is not inherently bistable but attains that property by coaction with other elements in the assembly. Such coaction renders it necessary to manufacture the respective elements with close dimensions and tolerances, thereby increasing the cost of the devices; and even when the manufacturing materials and conditions are such as to produce the desired mechanical properties initially, these properties may not be retained after a period of use.

In the manufacture of switches and circuit breakers, each step of the process produces an element of cost. One such step is the prestressing of the mechanically bistable element. In switches and circuit breakers of the types currently used, the attachment of an element with contact surfaces, typically an element having a coating or overlay of precious metal, is a separate step as well as a separate cost element in the manufacturing process.

One object of this invention is to provide a method and apparatus for producing inherently mechanically bistable blade elements. These elements are prestressed and formed to retain their prestressed property without dependence on coaction with other elements of the snap action devices in which they are used. Therefore, they are essentially "drop-in" elements that are merely placed and confined within the structures of switches, circuit breakers or other bistable snap action devices, in positions for actuating the operative elements therein. With bistable elements of this type, the mechanical properties related to inherent bistability are independent of the dimensions and tolerances of other elements, being solely a function of inherent properties in the element itself.

A second object is to simplify the process of manufacture of such elements and to reduce costs by combining in a single step both the prestressing of the bistable element and the attachment of a contact element for use in a switch or circuit breaker embodiment.

A third object is to provide methods and apparatus for imparting accurately predetermined stress to each element in the process of making it bistable, whereby elements of this type may be made to satisfy a wide variety of specifications, and whereby the elements may be mass produced cheaply but within close tolerances.

The above-mentioned properties of mechanical bistability, as required for particular snap action devices, may be defined in different ways with reference to the geometry of the element. In the case of blade elements of the type described in said U.S. patent, a feature of reference is the "nominal plane" of the blade, that is, the plane in which the entire blade lies prior to being put in the prestressed condition. Certain specifications prescribe the displacement of the unrestrained moving portion of the element from this plane caused by the prestressing alone. Other specifications prescribe that such moving portion shall produce a reaction force of stated magnitude upon an abutment displaced a predetermined distance from the reference plane. It is a further object of this invention to provide methods and apparatus for producing inherently bistable elements that are closely calibrated according to either of these types of specifications.

Further objects of the invention are to provide methods and apparatus adapted for automatic mass production of bistable elements, particularly elements produced from elongated strips of mutually connected blanks.

With the foregoing and other objects of the invention in view, the features of this invention include a mechanically bistable, self-supporting blade element formed from a substantially flat, initially unstressed sheet of spring material and having two legs and a bridging portion integrally connecting an end of each leg to an end of the other. The bridging portion may comprise any of several configurations, for example an inner leg extending between two outer legs and being deflected normally to the nominal plane of the outer legs. A second form may be a loop whereby the blade element is of simple U-shaped configuration. A third form may comprise two inner legs each connected at one end to an outer leg and at the other end to the other inner leg. A fourth form may comprise two inner legs with a bridging portion substantially surrounding them. In each of these configurations means are provided to displace two legs by moving them relatively to one another while confining them to a substantially coplanar relationship within their nominal plane, whereby the bridging portion is caused to deflect in a direction normally to such plane. Means are provided for progressively controlling the relative displacement of the two legs, so as to obtain a deflection of the bridging portion of precisely predetermined magnitude. The blade element is then permanently formed by attaching together portions of the two legs so that their relative positions remain fixed. The attaching means may take different forms, for example an attaching strip of suitable material such as a contact strip; or, the legs ma be attached directly to one another if they are in overlying or contiguous contact.

The foregoing steps for making the blade elements bistable can be carried out by the use of manufacturing apparatus designed for receiving preformed, unstressed, flat blade blanks, and for stressing them under mechanical restraints while detecting the resulting deflection of the bridging portions normally to the initial or nominal plane. The apparatus is provided with means operable when the desired deflection has been attained to secure the relatively displaced leg portions of the blade together, whereby the stress is permanently imparted to the element. Such apparatus may have any of several means for detecting the normal deflection, depending upon the performance specifications.

Other features and objects of the invention will become evident from the following description.

DRAWINGS

FIG. 8 is a plan view of the assembled switch of FIG. 7 with the top cover removed.

FIG. 9 is a side elevation in section on line 9—9 of FIG. 8.

FIG. 10 is a left end elevation of the assembly of FIG. 9.

FIG. 11 is a right end elevation of the assembly of FIG. 9.

DETAILED DESCRIPTION

The drawings illustrate embodiments of a bistable blade element, apparatus for making the element and a switch incorporating the element. As described herein, the invention is adapted for producing bistable elements having various configurations. Such elements may be incorporated in snap acting devices of other forms, and the apparatus for producing the elements is likewise adapted for structural modification, as will be evident from the following description.

Figure 1:
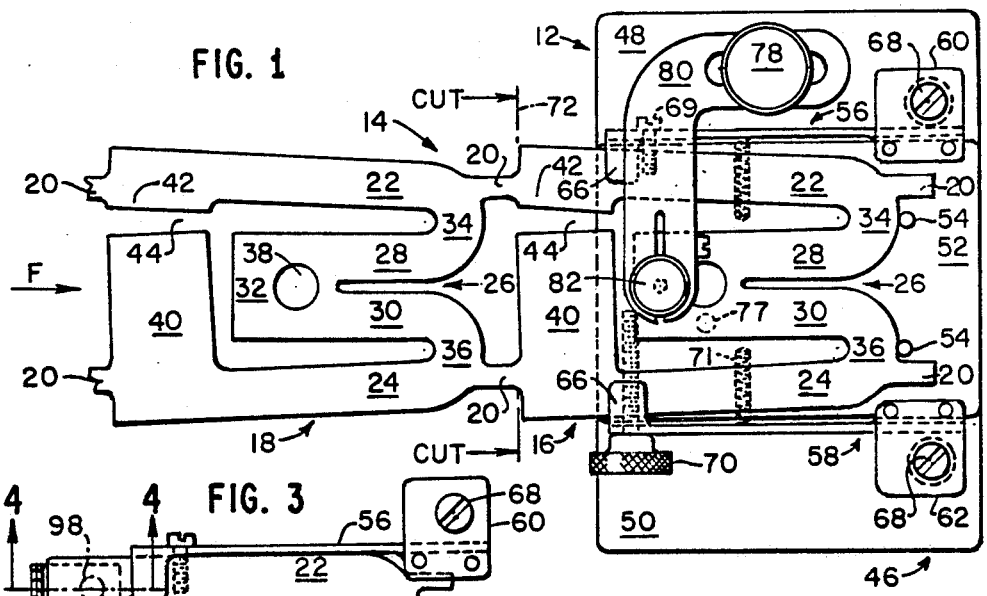
FIG. 1 is a plan view of apparatus for producing bistable elements according to the invention.

As illustrated in FIG. 1, manufacturing apparatus generally depicted at 12 is adapted for receiving an elongate strip 14 of flat preformed spring material comprising a plurality of connected blade blanks such as 16 and 18 mutually connected by breakaway tabs 20. The strip 14 is typically formed of thin spring metal stock, although in some cases it may be formed of a sheet of resilient plastic material, It may also be of laminar construction formed of plural layers having different coefficients of thermal expansion, in which case a snap action can be produced by a change of temperature rather than by an applied external force.

The strip 14 is preferably formed from an elongate or continuous strip of material initially of uniform width, by stamping, punching or photoetching the individual blanks such as 16 and 18. In any case the strip 14, after the formation of such blanks, is preferably in an unstressed, flat condition prior to insertion of an end thereof into the apparatus 12 in the direction of the arrow F.

Each blank comprises a pair of outer legs 22 and 24 and a bridging portion 26. As referred to herein, the "bridging portion" refers to all of the portions of the blank that integrally connect together an end of the leg 22 with an end of the leg 24. In the illustrated embodiment the bridging portion 26 comprises a pair of inner legs 28 and 30 integrally connected together at one end by a portion 32, and each being connected at its other end with one of the legs 22 or 24 by a curved portion 34 or 36, respectively. A circular locating hole 38 is formed in the portion 32.

The outer leg 24 has an elongate extension 40, and the outer leg 22 has a shorter extension 42, the adjacent edges of these extensions being separated by a space 44.

The strip 14 is inserted in one side of the apparatus 12 as shown in FIG. 1. This apparatus includes a base 46 having side portions 48 and 50 and an integral central platform portion 52. The platform 52 is elevated above the portions 48 and 50 to form a surface aligned with and supporting the inserted blade blank such as 16. Retractable pins 54 are mounted in the platform and serve as abutments for the engagement with and locating the bridging portion 26 of the blank.

Rails 56 and 58 are supported by brackets 60 and 62 on the portions 48 and 50 of the base, respectively. Each rail comprises a vertical portion or skirt 64 and a horizontal portion 66 at right angles thereto, the portions 66 directly and slidingly overlying the blank 16. The horizontal portions 66 restrain the blank to lie flat upon the platform 52 but allow it to slide on the platform during stressing and calibration as described below. The portions 66 are preferably small in projected area on the blank and located at the ends of the rails nearest the space 44, thereby confining their restraint on the blade substantially to those ends. Each of the brackets 60 and 62 is secured to the base by a screw 68. Preferably, the rail 56 is held in a fixed position on the base, but may be adjusted pivotally by means of a screw 69, while the rail 58 is pivotal about its screw 68 by means of a thumb screw 70 bearing on the vertical portion 64 and threaded into the platform 52. Springs 71 are located to urge the rails out of contact with the blank when the strip 14 is being advanced.

Figure 2:
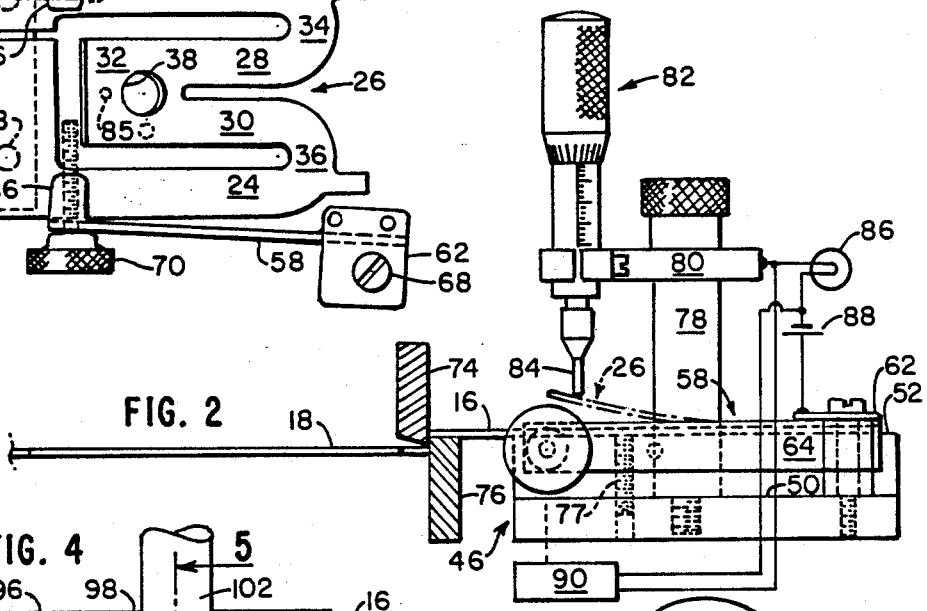
FIG. 2 is a side elevation of the apparatus of FIG. 1.

With the blank 16 in the position illustrated in FIG. 1, the tabs 20 connecting it to the blank 18 are severed at the cut line 72 by means of a knife 74 and anvil 76 (FIG. 2). After these preliminary steps the apparatus is ready to form a prestressed blade element.

Stress is applied to the blank 26 by turning the thumb screw 70 manually or by motor means (not shown), tending to close the space 44. The resulting relative movement of the outer legs 22 and 24 is restricted to the initial or nominal plane of the blank 16, the legs being confined to move in this plane by the rails 56 and 58. The stress on the blank is in the nominal plane of the blank and causes the bridging portion 26, and in particular the inner legs 28 and 30 and the connecting portion 32, to be deflected above the nominal plane of the blank as shown in FIG. 2. This deflection may be initiated by a slight pressure applied to the portion 32 by a screw 77 threaded in the platform 52. The progressive deflection of the bridging portion 26 results from the stress caused by the progressive relative displacement of the outer legs and directed in their nominal plane. The platform 52 is preferably recessed in the areas beneath the projecting tabs 20 to prevent the latter from engaging the platform and raising the blade as it deflects.

Figure 3:
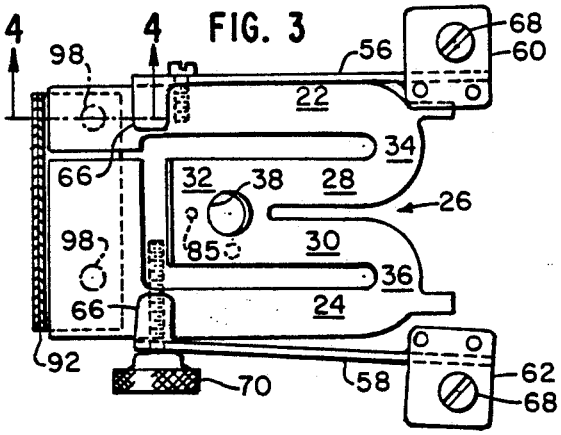
FIG. 3 is a fragmentary plan view of the apparatus of FIG. 1 with a blade element in the stressed condition ready for attachment of a contact strip.

Means for detecting the deflection of the bridging portion 26 may take one or more of several forms. In the illustrated embodiment a pedestal 78 is secured to the portion 48 of the base and supports a bracket 80 mounting a micrometer gage 82. The gage 82 has a plunger 84 in position to contact the portion 32 on the bridging portion of the blank at a position 85 (FIG. 3). An electrical circuit is formed by connection of the plunger 84 through parts of the gage, the bracket 80, a lamp 86, a battery or other suitable voltage source 88, the bracket 62, the rail 58 and the blade blank 16, whereby the lamp is lighted when the deflection of the bridging portion 26 is sufficient to cause the portion 32 of the blank to touch the plunger. Thus, if it is desired to stress the blade blank until the bridging portion has been deflected a predetermined distance above the nominal plane of the blank, the thumb screw 70 is turned until the lamp 86 is lighted, whereupon further stressing of the blade is terminated. The apparatus is then in the position illustrated in FIG. 3.

As an alternative method of detecting the deflection of the bridging portion 26, the gage 82 may be replaced by a transducer that displays the reaction force of the bridging portion 26 upon a yielding plunger in the position of the plunger B4 when the end of the plunger is at a predetermined distance above the nominal plane of the blank.

The turning of the thumb screw 70 may be arrested automatically at a predetermined deflection of the bridging portion 26 by any suitable means, for example a motor driving circuit 90 (FIG. 2) mechanically connected for rotating the thumb screw and having an electrical circuit connected in parallel with the lamp 86 and energizable to stop the motor. Conventional controls may be provided in the circuit for initiating and continuing the turning of the screw 70 until the detection circuit is completed by contact between the bridging portion 26 and the plunger 84.

Figure 4:
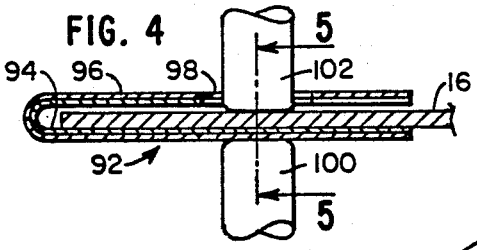
FIG. 4 is a detail elevation in section on line 4—4 of FIG. 3 showing electrodes for welding a contact strip.
Figure 5:
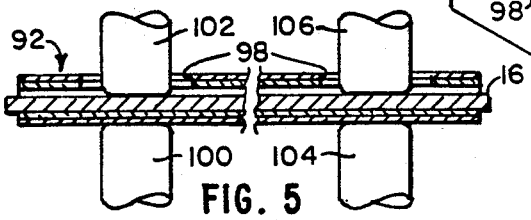
FIG. 5 is an elevation in section taken on line 5—5 of FIG. 4.

Either before or after the deflection of the element 16 has been arrested, a U-shaped contact strip 92 (FIGS. 4, 5 and 6) is inserted over the extensions 40 and 42 of the outer legs 22 and 24, and after the deflection has been arrested the welding of the strip 92 to these portions is completed to hold the outer legs permanently in the desired prestressed condition of the blade. For use in a switch, the strip 92 is preferably formed with an electrically conductive surface. It may comprise a beryllium copper, bronze, steel or brass strip 94 with a silver overlay 96 on the outer surface. To obtain effective welding, a pair of apertures 98 are preferably formed in one side of the U-shaped strip. A weld is produced by placing one electrode 100 against the underside of the strip 92 and a second electrode 102 through an aperture 98 so as to engage directly with the blank 16. Ultrasonic welding may then be effected to join the lower surface of the blank 16 to the inner, uncoated surface of the strip 92. Thus an effective weld is obtained between inner, uncoated surfaces of the strip 92 and blank 16.

Other means of attachment of the strip 92 to the blank may be employed, such as other forms of welding, or soldering, brazing or riveting. In some cases a flat ribbon of metal may be substituted for the U-shaped strip 92. In place of the illustrated silver overlay 96 the contact material may take the form of contacts of silver or the like riveted or welded to the flat or U-shaped strip 92, in which case the strip may be simply made of brass or beryllium copper, for example, without an overlay.

The strip 92 may be fed to the apparatus of FIG. 1 in a direction transverse to the arrow F which indicates the direction of feeding the strip 14 of blanks. A long or continuous strip of U-shaped contact metal may be fed over the portions 40 and 42 of the blank and severed into separate pieces by a knife associated with a conventional automatic feeding mechanism (not shown). Alternatively, as noted above, the long strip may be simply a flat ribbon of material which overlies the blank.

In addition to the electrodes 100 and 102, electrodes 104 and 106 are provided. If desired, the electrodes 100 and 102 which attach the strip 92 to the portion 42 of the outer leg 22 may be energized at a different time than the electrodes 104 and 106, for example before or after the blank 16 has been inserted in the position illustrated in FIG. 1 but before the initiation of the prestressing action. The electrodes 104 and 106 are energized after the completion of the prestressing action when the blank is in the position illustrated in FIG. 3.

Figure 6:
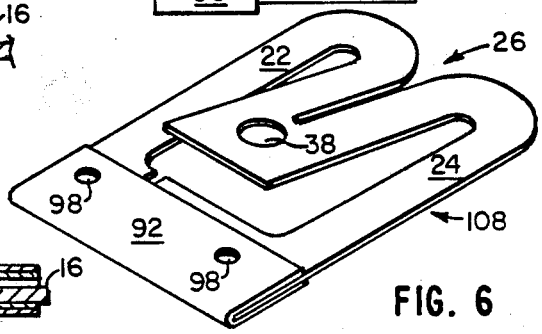
FIG. 6 is a view showing a fully fabricated inherently mechanically bistable blade element according to the invention.

Upon completion of the assembly and prestressing steps described above, the attached blank 16 and strip 92 form a permanently inherently mechanically bistable blade element 108 (FIG. 6). This element, when unsupported, has two stable positions, in each of which the internal stresses on the element are in equilibrium, and an external force may be applied to snap the element from one of its stable positions to the other.

FIGS. 7 to 11 illustrate an embodiment of a pushbutton switch of the single pole, double throw type, adapted to utilize the element 108. The switch is of simple construction and comprises a molded plastic base 110, a molded plastic cover 112, metal terminal contact strips 114 and 116, a metal center strip 118, a molded plastic pushbutton 120 and assembly screws 122. The terminal strips 114 and 116 are respectively received in grooves 124 and 126 in the cover and base. The center strip 118 has a hole 128 aligned with the locating hole 38 in the element 108, and a second hole 130 aligned with a hole 132 in the cover and a hole 133 in the base. The pushbutton has one end 134 projecting through the holes 38 and 128 into a hole 136 in the base. An upper end 138 of the pushbutton slidably projects outwardly through a hole 140 in the cover. Shoulders 142 on the strip 118 project inwardly so as to underlie and bear upon the curved portions 34 and 36 of the bridging portion 26, as most clearly shown in FIGS. 8 and 9. A portion 144 of the strip 118 projects outwardly of the base and cover to provide means for electrical connection to the bistable element 108 comprising the center contact of the switch.

Figure 7:
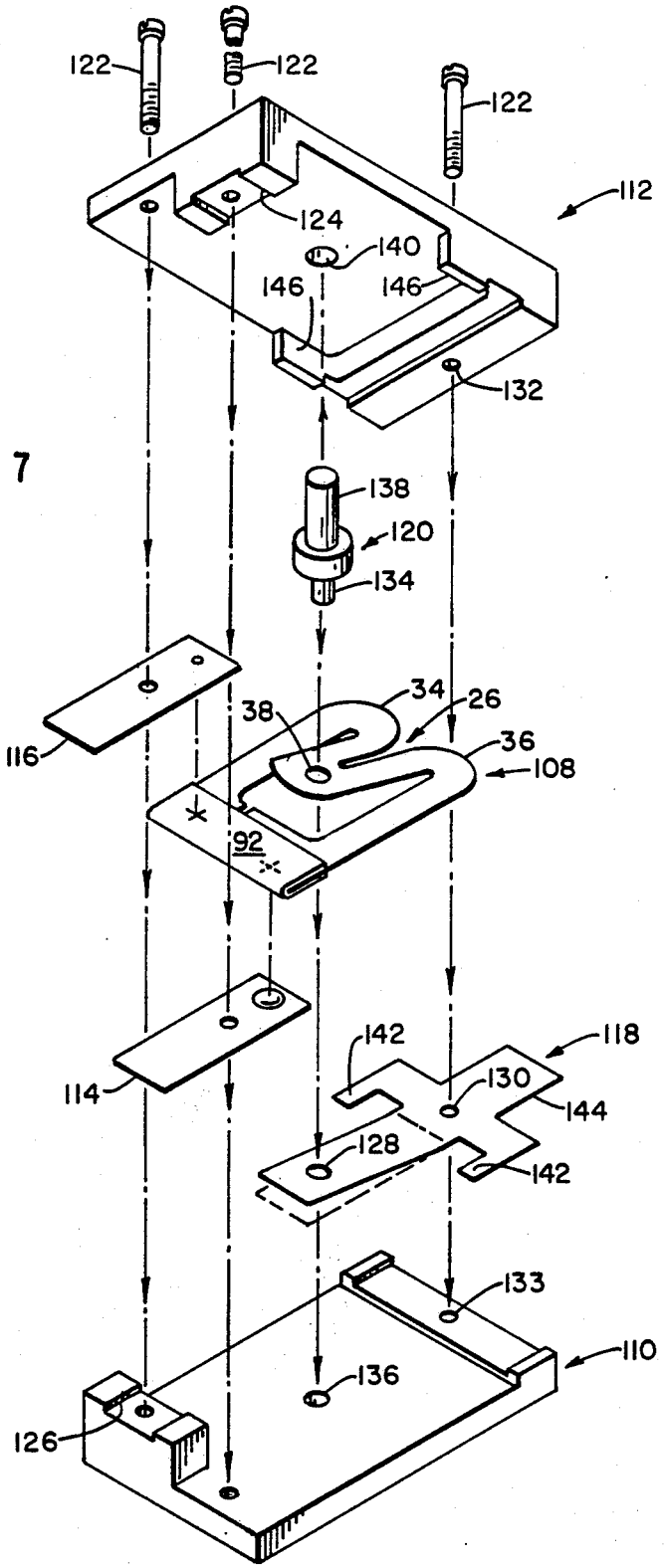
FIG. 7 is an exploded view showing the assembly of the blade element of FIG. 6 in a single pole, double throw switch.

The shoulders 142 comprise biasing means for engagement with the curved portions 34 and 36 to bias the bridging portion 26 upwardly as viewed in FIGS. 7 and 9. With the pushbutton 120 in its undepressed position, this causes the strip 92 of the element 108 to snap downwardly in the direction to engage the lower terminal contact strip 114. The switch is then in its normally unactuated condition, the strip 114 being the normally closed contact. By depression of the pushbutton 138 the element 108 is caused to snap into its actuated condition with the center strip 92 engaging the upper terminal strip 116. Releasing the pushbutton allows the switch to return to its unactuated condition by the spring action of the blade.

Various means may be employed to locate the bistable element 108 within the housing comprising the base 110 and cover 112. In the illustrated embodiment the pin 138, the locating hole 38 and the holes 136 and 140 in the base and cover, perform part of the locating function. To restrain the element 108 from rotation about the pin axis, shoulders 146 formed in the cover act as means to confine the element laterally.

If desired, the element 108 and strip 118 may be initially attached together as a subassembly, for example by welding together the overlying portions adjacent the holes 38 and 128. This further simplifies the final assembly.

A circuit breaker may be constructed as a variation of the embodiment of FIGS. 7 to 11. For example, two lower strips 114 or two upper strips 116 may be provided. In one position the strip 92 bridges the contacts and in the other position it disconnects them. This requires only a simple modification of the base and cover structures. It will be noted that in a circuit breaker embodiment, all of the current flows through the strip 92. The portion of the element 108, comprising the outer legs 22 and 24 with the bridging portion 26, does not form part of the electrical circuit. Accordingly, the blade portion may be formed of nonconducting material, for example a resilient plastic. Obviously, in such a case alternative means must be employed for connecting the contact strip 92 to the blade such as rivets, screws, epoxy or other adhesives.

The embodiment of FIGS. 7 to 11 operates as a push-to-actuate, self-returning switch. By simple alteration of the biasing means a substantially similar embodiment may be made to operate as a push-on, pull-off switch. Thus the points of support for the blade such as the biasing shoulders 142 permit the switch to have any desired motion differential for actuation within the limits defined by the blade when it is completely unsupported.

Figure 12:
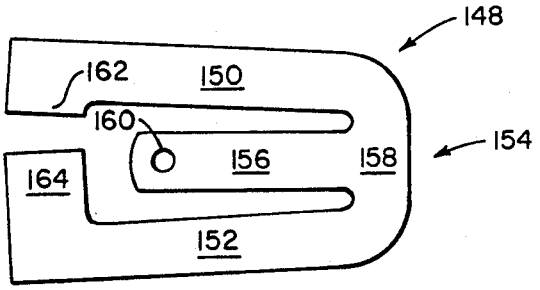
FIGS. 12 to 15 illustrate alternative embodiments of blade blanks.

FIGS. 12 to 16 illustrate alternative forms of blade blanks. FIG. 12 illustrates a blank 148 having a pair of outer legs 150 and 152 and a bridging portion 154, the bridging portion comprising a center leg 156 and portions 158 integrally connecting the three legs. The leg 156 has a locating hole 160. The outer legs have extensions 162 and 164 similar to those on the blanks 16 and 18 previously described. The blade is stressed in a manner similar to the blanks 16 and 18.

Figure 13:
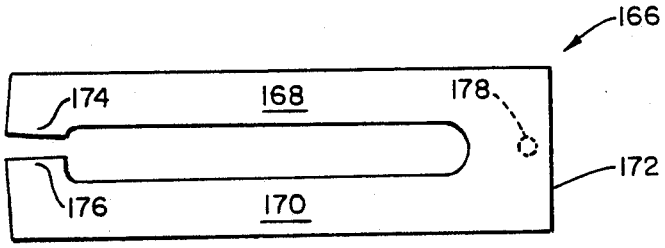

FIG. 13 illustrates a simplified form of blade blank 166 comprising outer legs 168 and 170 and a bridging portion 172 interconnecting the outer legs. The outer legs have extensions 174 and 176. This blank is stressed by displacing the outer legs 168 and 170 toward one another in a coplanar relationship as in the embodiment of FIGS. 1 to 5. The resulting stress causes a point 178 on the bridging portion 172 to deflect from the nominal plane of the blade in a manner analogous to the deflection of the bridging portions of the blades 16, 18 and 148 previously described.

Figure 14:
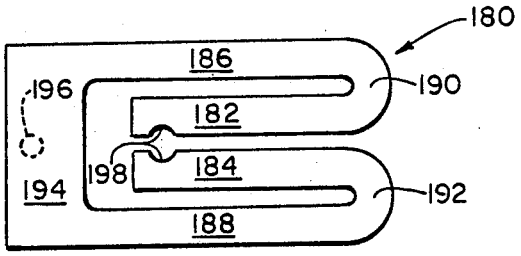

FIG. 14 illustrates a blade blank 180 comprising inner legs 182 and 184, outer legs 186 and 188, curved portions 190 and 192 and a portion 194. This blank is suitable for a variation of the method described in connection with FIGS. 1 to 5, wherein the blank is prestressed by relatively displacing the inner legs 182 and 184 away from one another, rather than displacing the outer legs toward one another. The relative displacement of the inner legs results in the deflection of a portion 196 from the nominal plane of the blade, in a manner analogous to the deflection of the portion 85 in FIG. 3. In this form of the blank, the "bridging portion" comprises the portions 186, 188, 190, 192 and 194.

As viewed in FIG. 14, the blank is prestressed by applying forces to the left ends of the inner legs 182 and 184 to displace them relatively and in coplanar relationship. When a sufficient stress has been applied to cause the portion 196 to be deflected the required amount above the nominal plane of the blank, the left ends of these legs are permanently secured together. Various means may be provided for application of these forces, and preferably this is accomplished by means located above and below the nominal plane of the blank and adapted for movement normally to that plane. For example, the legs 182 and 184 may have curved cutouts 198 for receiving an expansible rivet. A tool may be inserted through the rivet and caused to expand it progressively until the desired stress has been applied. Thus the rivet performs the dual functions of applying the stress to the blade and permanently attaching together the legs 182 and 184. Alternatively, a tapered pin may be driven progressively through the notches 198 to spread the legs 182 and 184, and a strip similar to the strip 92, having an elongated aperture over the notches 198 and the tapered pin, may then be welded to the respective legs 182 and 184 to fix them permanently.

In any of the above-described embodiments of the blade blank, the legs may be preformed in a slightly flared configuration as shown, so that they will approach parallelism as the blank is prestressed.

In the case of the blanks of FIGS. 1, 12 and 13, the prestressing is preferably accomplished by displacing the outer legs toward one another, thereby tending to close the space 44. Typically, this space is not completely closed when the prestressing step is terminated, and it is bridged by a strip such as the strip 92 which attaches them together. Alternatively, referring to FIG. 1 for example, the extensions 40 and 42 of the outer legs may be lengthened so that the space 44 is closed or nearly closed prior to the prestressing step, and the extensions may be slightly displaced normally to the nominal plane so that they will overlap during the prestressing step. At the termination of the prestressing step the overlapping portions of these extensions may be welded directly together, thereby eliminating the need for a separate strip 92.

Figure 15:
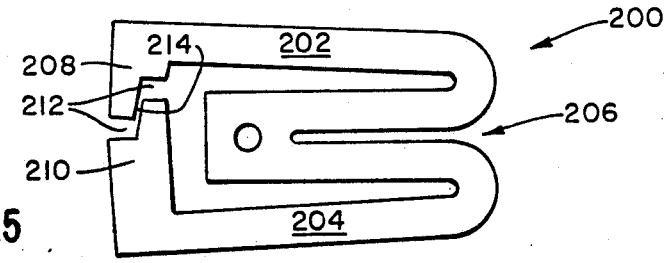

FIG. 15 illustrates another configuration of the blade blanks that eliminates the need for the strip 92. In this embodiment a blank 200 is formed substantially in the configuration of FIG. 1, with outer legs 202 and 204 and a bridging portion 206. In this embodiment the leg 202 has an extension 208 of stepped form, and the leg 204 has an extension 210 also of stepped form, with spaces 212 between these extensions. These spaces are closed as the blank is prestressed, but are not completely closed when the prestressing step is terminated. Upon such termination, a weld is made between the extensions at 214 where they are closely contiguous or in mutual contact.

It will be recognized that the bistable element of this invention may be mounted for actuation by means other than the pushbutton of FIGS. 7 to 11. For example, other mountings may provide for actuation by employing a sliding base, a toggle switch lever, a wheel disc actuator, a plunger or a diaphragm.

Figure 16:
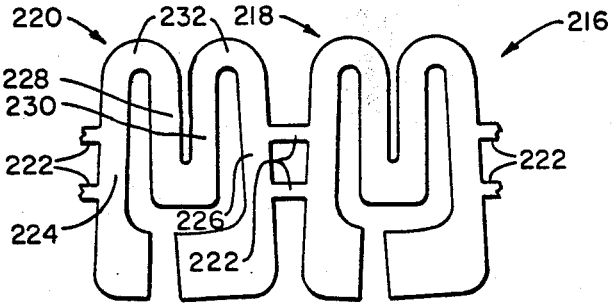
FIG. 16 illustrates an alternative form of elongate strip of blade blanks, preferred for maximum dynamic life.

FIG. 16 illustrates an alternative form of elongate strip 216 of blade blanks such as 218 and 220. These blanks, except for their orientation on the strip and the locations of connecting breakaway tabs 222, are of the same general form as the blanks 16 and 18 of FIG. 1, although they could also have any of the forms of FIGS. 12 to 15. Where using the strip 216 with the apparatus of FIGS. 1 to 3 it is preferred to employ a suitable feeding mechanism that separates each blank from the strip and automatically orients and inserts it between the rails 56 and 58.

The strip configuration of FIG. 16 is the preferred form where it is desired to produce bistable elements having the maximum dynamic life. Each blank includes outer legs 224 and 226 joined by the tabs 222, inner legs 228 and 230 and loops 232 joining the inner and outer legs. Since in this embodiment there are no tabs on the loops tending to reduce the areas of flexure, there is a smoother distribution of stress in these areas and there are no sharp stress points tending to cause eventual failure of the blade.

An important advantage of the present invention, as described in connection with FIGS. 1 to 5 for example, is that the required mechanical properties of the blade element can be achieved without the necessity of adherence to dimensional tolerances as close as those required for achieving similar performance characteristics in blade elements such as those described in said U.S. Pat. No. 4,424,506. For example, where the blade element of such patent is forced over a mounting pin that prestresses the legs to produce the required snap action, the dimensional tolerances of both the blade and the pin may be of the order of 0.0005 inch; whereas the blade dimensions for the practice of the present invention may have tolerances as great as 0.005 to 0.010 inch to achieve the same mechanical characteristics. Differences of manufacturing tolerances of this order of magnitude will obviously have great significance in terms of manufacturing cost.

We claim:

1. A method of forming an inherently mechanically bistable element comprising the steps of forming a blade element blank from a substantially flat, unstressed sheet of spring material to include at least two legs and a bridging portion integrally connecting one end of each leg to one end of the other, supporting the blade element blank in a fixture adapted for controlled relative displacement of the other ends of said two legs in the nominal plane of said element, progressively relatively displacing said other ends while detecting the deflection of the bridging portion normally to said plane, arresting said relative displacement upon said detected deflection reaching a predetermined magnitude, and rigidly attaching together said other ends in their relative positions at the arrest.

2. A method according to claim 1, in which said other ends are restrained in coplanar relationship throughout said progressive displacement.

3. A method according to claim 2, in which one of said other ends is held fixed during said progressive relative displacement.

4. A method according to claim 1, in which said normal deflection is detected as a function of its lineal magnitude.

5. A method according to claim 1, in which said normal deflection is detected as a function of the reaction force of said bridging portion upon an abutment displaced from said nominal plane.

6. A method according to claim 1, in which plural mutually connected blade element blanks are formed in spaced relationship on said sheet, and including the step of advancing the blade element blanks into the fixture after said rigid attachment to support a succeeding blade element blank therein.

7. A method according to claim 1, in which the bridging portion is formed to include an inner leg portion extending between said two legs, said detection measuring the deflection of said inner leg portion from said nominal plane.

8. A method according to claim 1, in which said rigid attachment is effected by the detection of a deflection of predetermined magnitude.

9. Apparatus for producing inherently bistable elements comprising, in combination, means to support an initially flat blade element blank having two legs and a bridging portion integrally connecting one end of each leg to one end of the other, and adapted to restrain the other ends of the legs in substantially coplanar relationship while permitting them to be displaced relatively to one another and permitting said bridging portion to be deflected normally to the nominal plane of the blade element, means to displace said other ends relatively and progressively to produce a deflection of said bridging portion normally to said nominal plane, means to detect the magnitude of the deflection of said bridging portion, and means to terminate the relative displacement.

10. Apparatus according to claim 9, including means for rigidly attaching said other ends together in a selected relative displacement.

11. Apparatus according to claim 10, including means for inserting a strip of material over said other ends, and means for rigidly attaching said strip to said other ends.

12. Apparatus according to claim 10, in which said detection means is operative upon a deflection of predetermined magnitude to actuate said attaching means.

13. Apparatus according to claim 9, in which said detection means is operative upon a deflection of predetermined magnitude to actuate said terminating means.

14. Apparatus according to claim 9, in which the detection means is adapted to measure the lineal displacement of the bridging portion from said nominal plane.

15. Apparatus according to claim 9, in which the detection means includes an abutment and is adapted to measure the reaction force of said bridging portion upon said abutment.

16. Apparatus according to claim 9, including means to feed a strip of mutually connected blank blade elements seriatim into a supported position for said displacement and deflection.

17. Apparatus according to claim 9, in which the supporting means is adapted to clamp one of said other ends in fixed position and said displacing means is adapted to displace the other of said other ends.

* * * * *